United States Patent [19]

Flinn, Jr.

[11] Patent Number: 4,505,597

[45] Date of Patent: Mar. 19, 1985

[54] NOVELTY ALARM CLOCK

[76] Inventor: Jack L. Flinn, Jr., 4440 NW. 19th St., Apt. L-213, Lauderhill, Fla. 33313

[21] Appl. No.: 555,346

[22] Filed: Nov. 28, 1983

[51] Int. Cl.[3] ..... G04C 21/16; G04B 23/00

[52] U.S. Cl. ..... 368/250; 368/262

[58] Field of Search ..... 368/10, 12, 72–74, 368/243–244, 250, 254, 262, 276

[56] References Cited

U.S. PATENT DOCUMENTS 3,797,223 3/1974 Oliveri ..... 368/262

4,068,882 6/1977 Muncheryan ..... 368/12

4,218,875 8/1980 Rothman ..... 368/73

*Primary Examiner*—Vit W. Miska

*Attorney, Agent, or Firm*—Joseph Zallen

[57] ABSTRACT

A novelty alarm clock having an alarm clock means with an external push-button alarm shut-off and a resilient air filled flexible casing surrounding the clock means; the casing including a trigger means connected to the alarm shut-off and terminating in a portion of the exterior of the casing; the portion being manipilable so as to permit pushing or pulling of the shut-off.

6 Claims, 3 Drawing Figures

NOVELTY ALARM CLOCK

BACKGROUND OF INVENTION

This invention relates to clocks, and more particularly to a novel form of alarm clock which will permit it to be thrown on the floor to shut off the alarm.

Typical alarm clocks, whether electric, battery, or manual, have controls for setting the alarm and controls for shutting off the alarm. A person utilizing an alarm clock to wake him up from sleep generally has difficulty finding the shut-off because he is not fully awake.

The prior art does not provide any easy means for shutting off the alarm. Although various protected and packaged alarm clocks have been described, as for example U.S. Pat. Nos. 2,681,142, 2,701,947, 3,747,319, 4,201,293, none provide any easy means to shut off the alarm.

One object of the present invention is to provide an alarm clock assembly whose alarm can be readily shut off by merely throwing the assembly on to the floor.

Other objects and advantages of this invention will be apparent from the description and claims which follow, taken together with the appended drawings.

SUMMARY OF INVENTION

This invention comprises generally an alarm clock having conventional means (such as push-button or knob or dial) for setting the alarm and an external push-button for shutting off the alarm. The clock is encased in a foam or sponge wrapper body member preferably shaped to resemble some well-known object such as such as a basketball, football or beer can. The body member is readily disassembled and assembled to provide access into the interior where the clock is positioned. The body member also has various removable plugs which permit access to certain portions of the clock. The push-button on the alarm clock has an extension to a trigger whose exterior surface is rigid and coextensive with the main surface of the body member. A spring means is associated with the trigger and extension so that when the alarm is ringing and the entire assembly thrown on the floor, pressure on the trigger will shut off the alarm when it hits the floor.

In its preferred form, body member has two foam rubber shells which are attachable to one another by means of fabric loops as for example, Velcro. The removable plugs likewise have fabric loop attachment means. The alarm clock can be a mechanically wound clock but is preferably a battery operated clock so that it would require very little attention. Once the alarm has been set, it can be turned off and reset at will by the slight movement of the trigger.

Figure 1:
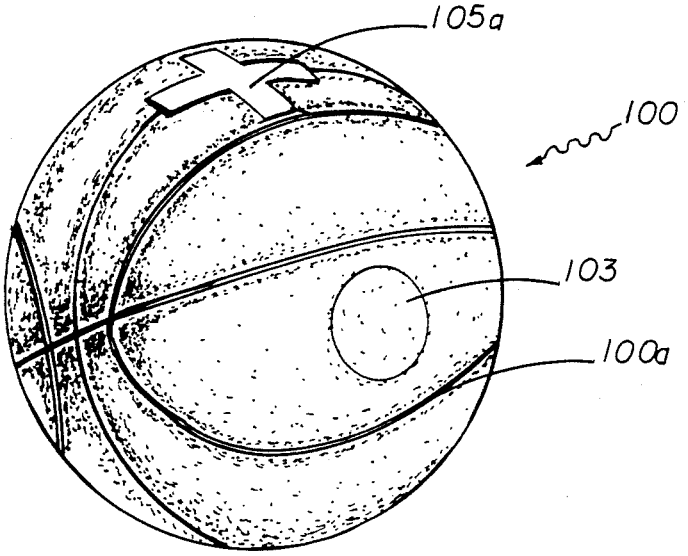
FIG. 1 is a perspective top view of an embodiment of this invention in the shape of a basketball showing the trigger portion and front access plug.
Figure 3:
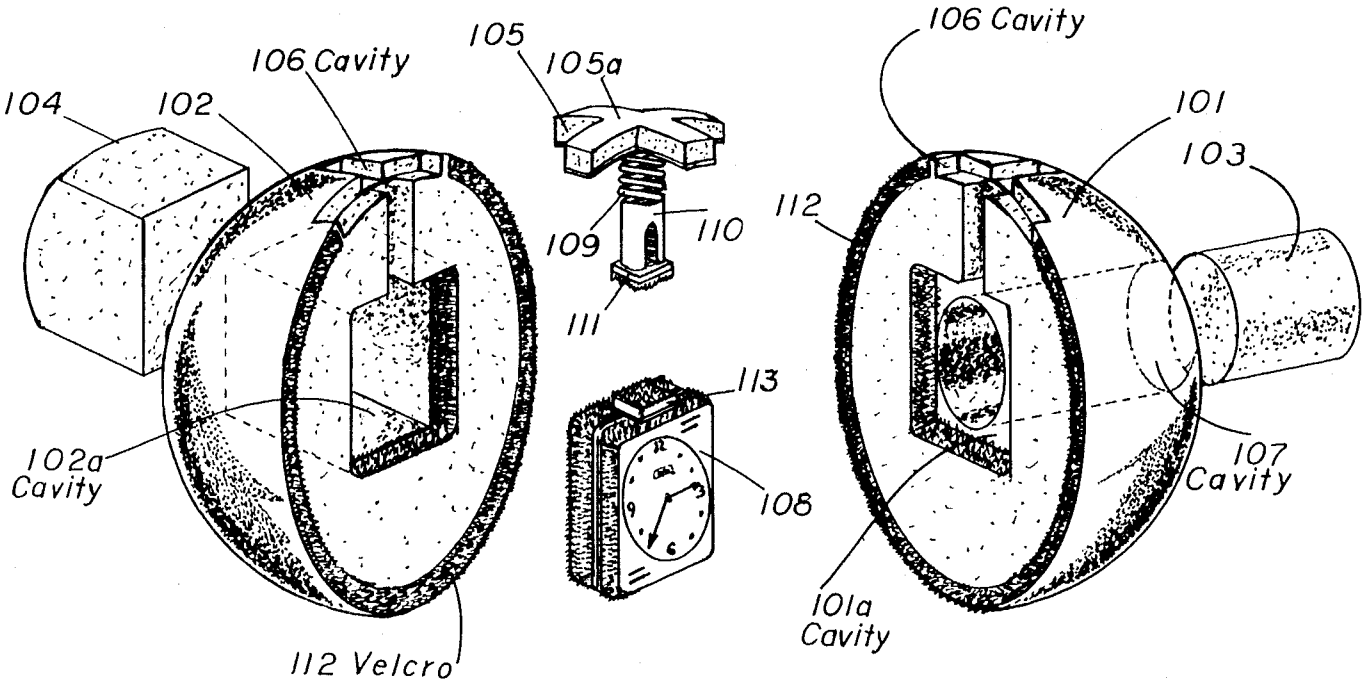
FIG. 3 is an exploded view of the embodiment of FIG. 1.

Referring now to the embodiment illustrated in FIGS. 1 and 3, a simulated basketball 100 is shown made of foam rubber in registering shell sections 101 and 102. The exterior surface 100*a* has markings to make it resemble a basketball. The two sections 101 and 102 have attaching surfaces 112 made of readily-attachable and detachable materials, as for example, pressure sensitive adhesive or interlocking nylon loops e.g. Velcro.

Within each section 101 and 102 there is a cavity 101*a* and 102*a* for housing a battery-driven clock 108 having an alarm trigger 113. Co-acting with the alarm trigger 113 is a trigger assembly seating in cavity 106, having an exterior relatively rigid surface 105*a*, such as sheet aluminum, a soft or foam rubber body portion 105 and a spring rod 109 connected by sleeve 110 to actuating plate 111 which is detachably attached to alarm plate 113.

When the entire device is in assembled condition the clock mechanism will actuate the alarm at the desired time and pressure on the trigger 105*a* will shut off the alarm. A plug 104 made of a similar foam rubber is insertable into a cavity in section 102 for access to the entire clock while a removable soft rubber plug 103 is insertable into cavity 107 and provides visual access and manipulative access to the clock and/or its settings.

Figure 2:
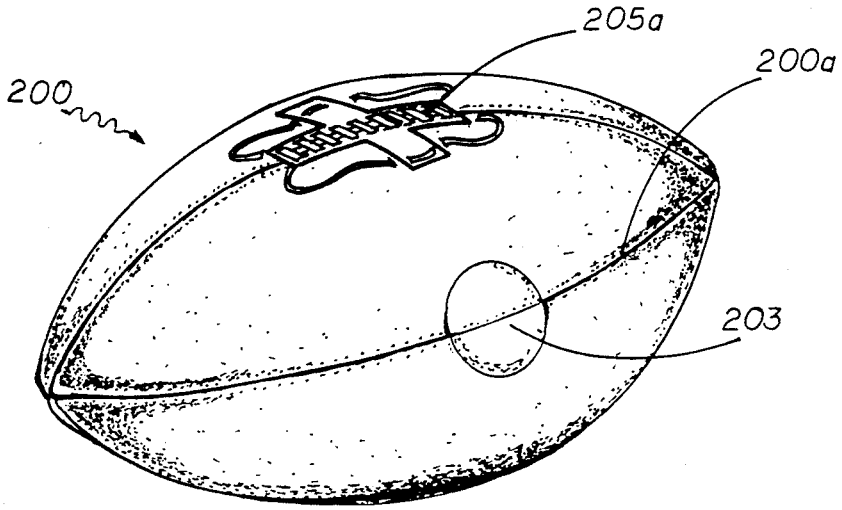
FIG. 2 is a perspective view of another embodiment of this invention, in the shape of a football.

The embodiment illustrated in FIG. 2 is likewise a two-piece device in the shape of a football 200 having attachable body sections 200 and 202, a removable plug section 203, a trigger section 205*a*, and a decorative surface 200*a* resembling the exterior surface of a football.

I claim:

1. A novelty alarm clock assembly comprising an alarm clock means having an external push-button alarm shut-off and a resilient air-filled flexible casing means surrounding said clock means; said casing means including a trigger means connected to said alarm shut-off and terminating in a portion of the exterior of said casing; said casing portion being manipulable so as to permit pushing or pulling on said shut-off.

2. The assembly of claim 1 wherein said casing comprises two attachable shells.

3. The assembly of claim 1 wherein said casing includes removable plug means for access to said clock means.

4. The assembly of claim 2 wherein said casing shell portions are detachably removable from one another.

5. The assembly of claim 1 wherein said casing is rollable.

6. The assembly of claim 5 wherein said trigger means' external surface is denser than said casing, so that when the assembly is rolled the trigger means will tend to go to the bottom so as to actuate the shut-off.

* * * * *